US012575636B1

(12) United States Patent
Suffolk et al.

(10) Patent No.: US 12,575,636 B1
(45) Date of Patent: Mar. 17, 2026

(54) BALLET POINTE SHOE

(71) Applicant: Drew Layne, LLC, Lewisville, TX (US)

(72) Inventors: Mark Suffolk, Oak Point, TX (US); Keri Suffolk, Oak Point, TX (US)

(73) Assignee: Drew Layne, LLC

( * ) Notice: Subject to any disclaimer, the term of this patent is extended or adjusted under 35 U.S.C. 154(b) by 0 days.

(21) Appl. No.: 19/005,872

(22) Filed: Dec. 30, 2024

(51) Int. Cl.

| | |
|---|---|
| ***A43B 5/12*** | (2006.01) |
| ***A43B 7/1405*** | (2022.01) |
| ***A43B 13/12*** | (2006.01) |
| ***A43B 13/14*** | (2006.01) |
| ***A43B 23/08*** | (2006.01) |

(52) U.S. Cl.
CPC ..... *A43B 5/12* (2013.01); *A43B 7/141* (2013.01); *A43B 13/125* (2013.01); *A43B 13/141* (2013.01); *A43B 23/081* (2013.01)

(58) Field of Classification Search
CPC ..... A43B 5/12
USPC ..... 36/8.3, 113
See application file for complete search history.

(56) References Cited

U.S. PATENT DOCUMENTS

| | | | | |
|---|---|---|---|---|
| 1,525,848 A * | 2/1925 | Bonaventure | A43B 5/12 D2/941 |
| 1,937,218 A | 11/1933 | Di Rienzo | |
| 1,953,659 A | 4/1934 | Savino | |
| 2,118,835 A | 5/1938 | Capezio | |
| 4,026,046 A * | 5/1977 | Clark | A43B 5/12 12/142 R |
| 4,199,878 A * | 4/1980 | Wossner | A43B 23/087 36/108 |
| 4,333,472 A | 6/1982 | Tager et al. | |
| 5,035,069 A | 7/1991 | Minden | |
| 5,129,165 A | 7/1992 | Woodle | |
| 5,191,726 A | 3/1993 | Valle | |
| 5,220,735 A | 6/1993 | Raoul-Duval | |
| 5,469,641 A | 11/1995 | Subotic | |
| 5,740,618 A | 4/1998 | Minden | |

(Continued)

FOREIGN PATENT DOCUMENTS

| | | |
|---|---|---|
| WO | 2004107895 A1 | 12/2004 |
| WO | 2007029964 A1 | 3/2007 |
| WO | 2010132364 A1 | 11/2010 |
| WO | 2013101967 A1 | 7/2013 |

OTHER PUBLICATIONS

FAIPP Pre-Interview Communication dated Nov. 10, 2015, U.S. Appl. No. 14/373,993, filed Jul. 23, 2014.

(Continued)

*Primary Examiner* — Ted Kavanaugh
(74) *Attorney, Agent, or Firm* — Conley Rose, P.C.; Michael W. Piper; Elexis A. Jones

(57) ABSTRACT

A ballet pointe shoe prior to first use by a dancer is disclosed that comprises a toebox, a platform, a heel, an upper, a shank, a sole, a curve on the shank between the heel and the toebox positioned to include a preferred break point. The first curve follows an arch of the dancer's foot when the dancer is wearing the ballet pointe shoe. The ballet pointe shoe also comprises a flexible support member positioned at the curve that elastically sets the shank in the curve at the time of manufacturing of the ballet pointe shoe. The flexible support member enables the ballet pointe shoe to flatten when weight is applied and elastically return to the curve.

17 Claims, 3 Drawing Sheets

(56) References Cited

U.S. PATENT DOCUMENTS

| | | | | |
|---|---|---|---|---|
| 6,092,314 | A | 7/2000 | Rothbart | |
| 6,182,380 | B1 | 2/2001 | Liley | |
| 6,238,359 | B1 | 5/2001 | Anderson | |
| D499,958 | S | 12/2004 | Crane | |
| 7,036,244 | B1 | 5/2006 | Finch | |
| 7,900,375 | B2 | 3/2011 | Thoraval | |
| 7,921,579 | B1 | 4/2011 | French | |
| 9,491,981 | B2 | 11/2016 | Suffolk et al. | |
| 11,026,474 | B2 | 6/2021 | Suffolk et al. | |
| 2004/0093761 | A1 | 5/2004 | Nye | |
| 2005/0022421 | A1* | 2/2005 | Bruckner | A43B 23/081 36/11 |
| 2007/0000149 | A1 | 1/2007 | Juniman | |
| 2007/0199208 | A1 | 8/2007 | Wilkenfeld | |
| 2009/0151200 | A1 | 6/2009 | Niedermeyer et al. | |
| 2010/0263231 | A1 | 10/2010 | Smirman | |
| 2011/0010963 | A1 | 1/2011 | Webb | |
| 2011/0265348 | A1 | 11/2011 | Schmutte | |
| 2012/0055045 | A1 | 3/2012 | Wang | |
| 2018/0055139 | A1 | 3/2018 | Whiteside | |
| 2021/0345728 | A1* | 11/2021 | Fox | A43B 13/026 |
| 2022/0192316 | A1* | 6/2022 | Robacki | A43B 5/12 |

OTHER PUBLICATIONS

Final Office Action dated May 27, 2016, U.S. Appl. No. 14/373,993, filed Jul. 23, 2014.
Advisory Action dated Jul. 13, 2016, U.S. Appl. No. 14/373,993, filed Jul. 23, 2014.
Office Action dated Aug. 22, 2016, U.S. Appl. No. 14/373,993, filed Jul. 23, 2014.
Notice of Allowance dated Oct. 3, 2016, U.S. Appl. No. 14/373,993, filed Jul. 23, 2014.
Office Action dated Oct. 30, 2020, U.S. Appl. No. 16/000,833, filed Jun. 5, 2018.
Final Office Action dated Jan. 29, 2021, U.S. Appl. No. 16/000,833, filed Jun. 5, 2018.
Notice of Allowance dated Apr. 5, 2021, U.S. Appl. No. 16/000,833, filed Jun. 5, 2018.
Foreign Communication from a Related Counterpart—International Search Report and Written Opinion, dated Apr. 26, 2013, Application No. PCT/US2012/071888, filed Dec. 28, 2012.
Foreign Communication from a Related Counterpart—International Preliminary Report on Patentability, dated Jul. 10, 2014, Application No. PCT/US2012/071888, filed Dec. 28, 2012.
Suffolk, Mark, et al., "Toe Wedge for a Ballet Pointe Shoe," filed Dec. 29, 2011, U.S. Appl. No. 61/581,373.

* cited by examiner

BALLET POINTE SHOE

BACKGROUND

A ballet pointe shoe is a type of shoe worn by ballet dancers when performing pointe work (i.e. dancing "en pointe"). "En pointe" means "on the tip" and is part of a classical ballet technique in which dancers perform on the tips of their toes. Ballet pointe shoes developed from the desire for dancers to appear weightless and sylph-like.

SUMMARY

In one embodiment of the disclosure, a ballet pointe shoe prior to first use by a dancer is disclosed. The ballet pointe shoe comprises a toebox, a platform at a front end of the toebox, a shank, an upper, a heel, and a first curve on the shank between the heel and the toebox positioned to include a preferred break point. The first curve follows an arch of the dancer's foot when the dancer is wearing the ballet pointe shoe. A first ratio of (i) a radius of curvature of the first curve to (ii) a length of the ballet pointe shoe from a front end closest to the toebox to a back end closest to the heel is less than 100%. The ballet point shoe also comprises a second curve on the shank at least partially within the toebox. The second curve positions at least the toes of the dancer at an angle that increases from a back of the toebox to a front of the toebox when the dancer is wearing the ballet pointe shoe. A second ratio of (i) a radius of curvature of the second curve to (ii) the length of the ballet pointe shoe from the front end closest to the toebox to the back end closest to the heel is at least 25%.

In another embodiment of the disclosure, a ballet pointe shoe prior to first use by a dancer is disclosed. The ballet pointe shoe comprises a toebox, a platform, a heel, an upper, a shank, a sole, and a curve on the shank between the heel and the toebox positioned to include a preferred break point. The first curve follows an arch of the dancer's foot when the dancer is wearing the ballet pointe shoe. The ballet pointe shoe also comprises a flexible support member positioned at the curve that elastically sets the shank in the curve at the time of manufacturing of the ballet pointe shoe. The flexible support member enables the ballet pointe shoe to flatten when weight is applied and elastically return to the curve.

In yet another embodiment of the disclosure, a ballet pointe shoe prior to first use by a dancer is disclosed. The ballet pointe shoe comprises a toebox, a platform, a heel, an upper, a shank, a sole, and a first curve on the shank between the heel and the toebox positioned to include a preferred break point. The first curve follows an arch of the dancer's foot when the dancer is wearing the ballet pointe shoe. The ballet pointe shoe also comprises a second curve on the shank at least partially within the toebox. The second curve positions at least the toes of the dancer at an angle that increases from a back of the toebox to a front of the toebox when the dancer is wearing the ballet pointe shoe. The ballet pointe shoe additionally comprises a flexible support member positioned at the first curve that elastically sets the shank in the first curve at the time of manufacturing of the ballet pointe shoe. The flexible support member enables the ballet pointe shoe to flatten when weight is applied and then elastically return to the first curve.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
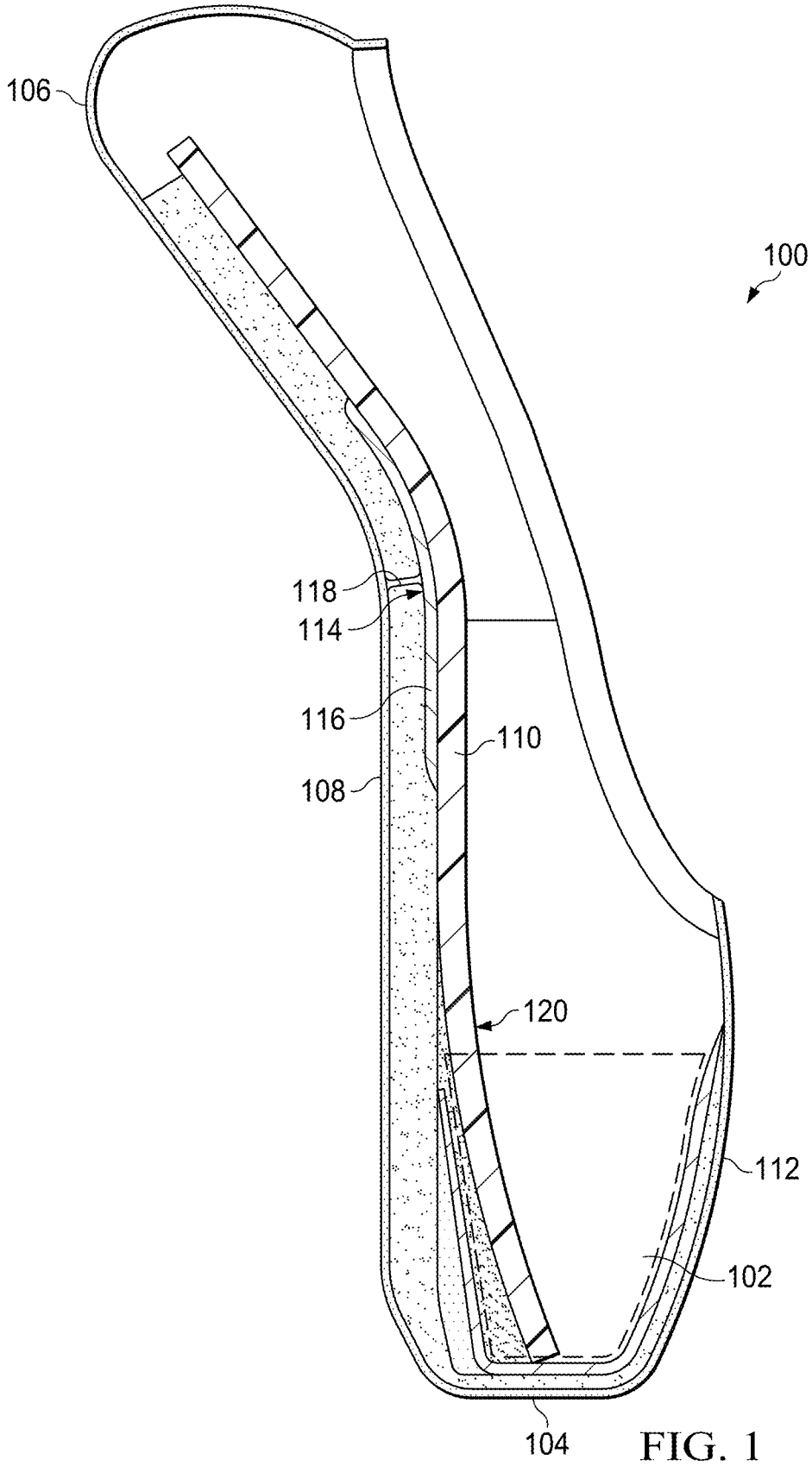
FIG. 1 illustrates a ballet pointe shoe according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Traditional ballet pointe shoes are comparable to flat shoes. They are made to fit a dancer's foot while the dancer's foot is flat on the ground. Traditional ballet pointe shoes may have a small curve at the arch of the dancer's foot established during manufacturing. As the dancer begins to break in the traditional ballet pointe shoe (e.g., by going in en pointe), the curve of the traditional ballet pointe shoe at the arch of the dancer's foot becomes larger as the shank of the traditional ballet pointe shoe begins to bend and mold to the dancer's foot shape. However, when the dancer steps flat again, that larger curve in the shank of the traditional ballet pointe shoe vanishes. Over time, as the dancer continues to break in the traditional ballet pointe shoe, that larger curve of the traditional ballet pointe shoe at the arch of the dancer's foot becomes more established such that it does not completely vanish when the dancer steps flat.

As discussed above, traditional ballet pointe shoes are made to fit the dancer's foot flat and then the traditional ballet pointe shoe can go en pointe. In contrast, the ballet pointe shoe disclosed herein is manufactured to fit a dancer's foot en pointe and then the ballet pointe shoe can go flat. In particular, the disclosed ballet pointe shoe includes a first curve on the shank between the heel and the toebox positioned to include the preferred break point. The first curve is established during manufacturing prior to first use of the ballet pointe shoe such as by using a different last that includes a bigger curve at the preferred break point than included in traditional lasts used to manufacture traditional ballet pointe shoes. This different last may have a different top and heel than traditional lasts because of the bigger curve at the preferred break point.

The first curve is bigger than the small curve at the arch of the dancer's foot included in traditional ballet pointe shoes. For example, a ratio of (i) a radius of curvature of the first curve to (ii) a length of the ballet pointe shoe from a front end closest to the toebox to a back end closest to the heel may be less than 100%. In other examples, the ratio of (i) the radius of curvature of the first curve to (ii) the length of the ballet pointe shoe from the front end closest to the toebox to the back end closest to the heel may be between 5% and 75%, between 10% and 55%, between 15% and 35%, or between some other range of percentages less than 100%.

The ballet pointe shoe disclosed herein may also comprise a flexible support member positioned at the first curve. The flexible support member may elastically set the shank in the first curve at the time of manufacturing of the ballet pointe shoe. The flexible support member may be a separate component coupled to the shank or the flexible support member may be a part of the shank. The flexible support member may enable the ballet pointe shoe to flatten when weight is applied and then elastically return to the first curve.

In some embodiments, the ballet pointe shoe disclosed herein also comprises a second curve on the shank at least partially within the toebox. The second curve is established during manufacturing prior to first use. The second curve positions at least the toes of the dancer at an angle that increases from a back of the toebox to a front of the toebox when the dancer is wearing the ballet pointe shoe. In regard to size of the second curve, a ratio of (i) a radius of curvature of the second curve to (ii) the length of the ballet pointe shoe from the front end closest to the toebox to the back end closest to the heel may be at least 25%. In other examples, the ratio of (i) the radius of curvature of the second curve to (ii) the length of the ballet pointe shoe from the front end closest to the toebox to the back end closest to the heel may be at least 60%, at least 75%, at least 90%, or some other percentage greater than 25%.

The first and second curves established during manufacturing create a dual curve system for the ballet pointe shoe disclosed herein. The dual curve system includes a positive curve (i.e., the first curve) and a negative curve (i.e., the second curve) on the inner part of the ballet pointe shoe that is against the dancer's foot (e.g., the shank, etc.). The positive and negative curves help mimic the shape of the bottom of the foot. This dual curve system is different than traditional ballet pointe shoes, which include a single, smaller positive curve at the arch of the dancer's foot. The dual curve system discussed herein creates an ergonomic shape against the bottom and back of the dancer's foot, maintaining more stable contact and positioning between the foot (including the arch and the toes) and the shoe throughout a dance.

The ballet pointe shoe disclosed herein has numerous advantageous over traditional ballet pointe shoes. For example, aesthetically the ballet pointe shoe disclosed herein looks nicer en pointe than traditional ballet pointe shoes. Additionally, the disclosed ballet pointe shoe is already broken via its initially construction to fit the dancer's foot en pointe. This saves dancers the many hours it takes to break in traditional ballet pointe shoes. Furthermore, since the ballet pointe shoe does not need to be broken in and the ballet pointe shoe includes a flexible support member positioned at the preferred break point, it is believed that the ballet pointe shoe disclosed herein should have a greater lifespan than a traditional ballet pointe shoe.

As discussed above and further below, the ballet pointe shoe disclosed herein may include a dual curve—one curve on the shank between the heel and the toebox positioned to include a preferred breakpoint and one curve on the shank at least partially within the toebox. Traditional ballet pointe shoes only include a single curve.

The ballet pointe shoe disclosed herein may be structured differently than traditional ballet pointe shoes. In particular, the ballet pointe shoe may include a flexible support member that results in a curve around the preferred breakpoint. The flexible support member elastically sets the shank in the curve at the time of manufacturing of the ballet pointe shoe and enables the ballet pointe shoe to flatten when weight is applied and then elastically return to the curve.

The ballet pointe shoe disclosed herein may include a larger curve established during manufacture on the shank between the heel and the toebox positioned to include a preferred breakpoint than is present in traditional ballet pointe shoes. For example, a ratio of (i) a radius of curvature of the curve to (ii) a length of the ballet pointe shoe from a front end closest to the toebox to a back end closest to the heel may be between 5% and 100%. In contrast, a ratio of (i) a radius of curvature of the single curve on the shank of a traditional ballet pointe shoe to (ii) a length of the traditional ballet pointe shoe from a front end closest to the toebox to a back end closest to the heel is between 111% and 280%.

Turning now to FIG. 1, FIG. 1 illustrates an embodiment of a ballet pointe shoe 100 having a toebox 102, a platform 104, a heel 106, a sole 108, a shank 110, and an upper 112. The toebox 102 is located in the front end of the ballet pointe shoe 100 and is a hard enclosure that encases and supports a dancer's toes. The front end of the toebox 102 is flattened so as to form the platform 104. The ballet pointe shoe 100 compresses the dancer's foot and the platform 104 functions as a contact surface to the floor, on which a dancer balances when in "en pointe" stance. The heel 106 of the ballet pointe shoe 100 is located at the back of the ballet pointe shoe 100, opposite the platform 104, and does not typically offer any structural support to the dancer. The sole 108 is the bottom part of the ballet pointe shoe 100, which in most ballet pointe shoes, is constructed from a single piece of leather attached to the shoe with adhesive reinforced by stitching along its edges. The shank 110 is a piece of rigid material that serves to stiffen the sole 108 to provide support for the arch of a dancer's foot when in "en pointe" stance. Shanks are typically made from leather, plastic, cardstock, or layers of glue-hardened burlap and are generally designed with a sufficient rigidity to support the body weight of a dancer, while still offering enough flexibility for a dancer to move her foot as necessary within the ballet pointe shoe 100. The shank 110 is often covered by a thin fabric, which directly contacts the bottom of the dancer's foot. The upper 112, typically made of satin or canvas, covers the exterior of the ballet pointe shoe 100, concealing the box and other internal structural elements, lending an aesthetically pleasing look to the shoe, as depicted in FIG. 1.

The ballet pointe shoe 100 may also comprise a first curve 114 of the shank 110. The first curve 114 of the shank 110 is between the heel 106 and the toebox 102 positioned to include a preferred break point for a dancer. In an embodiment, the preferred break point comprises the arch of the dancer's foot when the dancer is wearing the ballet pointe shoe 100. The first curve 114 follows an arch of the dancer's foot when the dancer is wearing the ballet pointe shoe 100. The first curve 114 is established during manufacturing prior to first use of the ballet pointe shoe 100. The first curve 114 of the shank 110 may be established using a particular last that includes a bigger curve at the preferred break point than included in traditional lasts used to manufacture traditional ballet pointe shoes. Since the first curve 114 is a bigger curve, the particular last may also include a different top and a different heel than traditional lasts. In some embodiments, the first curve 114 may be set in part by applying a weighted press to the shank 110 while fitted to the particular last. In contrast to traditional ballet pointe shoes, which are manufactured to fit a dancer's foot flat, the ballet pointe shoe 100 is manufactured to fit a dancer's foot en pointe via the larger first curve 114 and then the ballet pointe shoe 100 can go flat.

Figure 2:
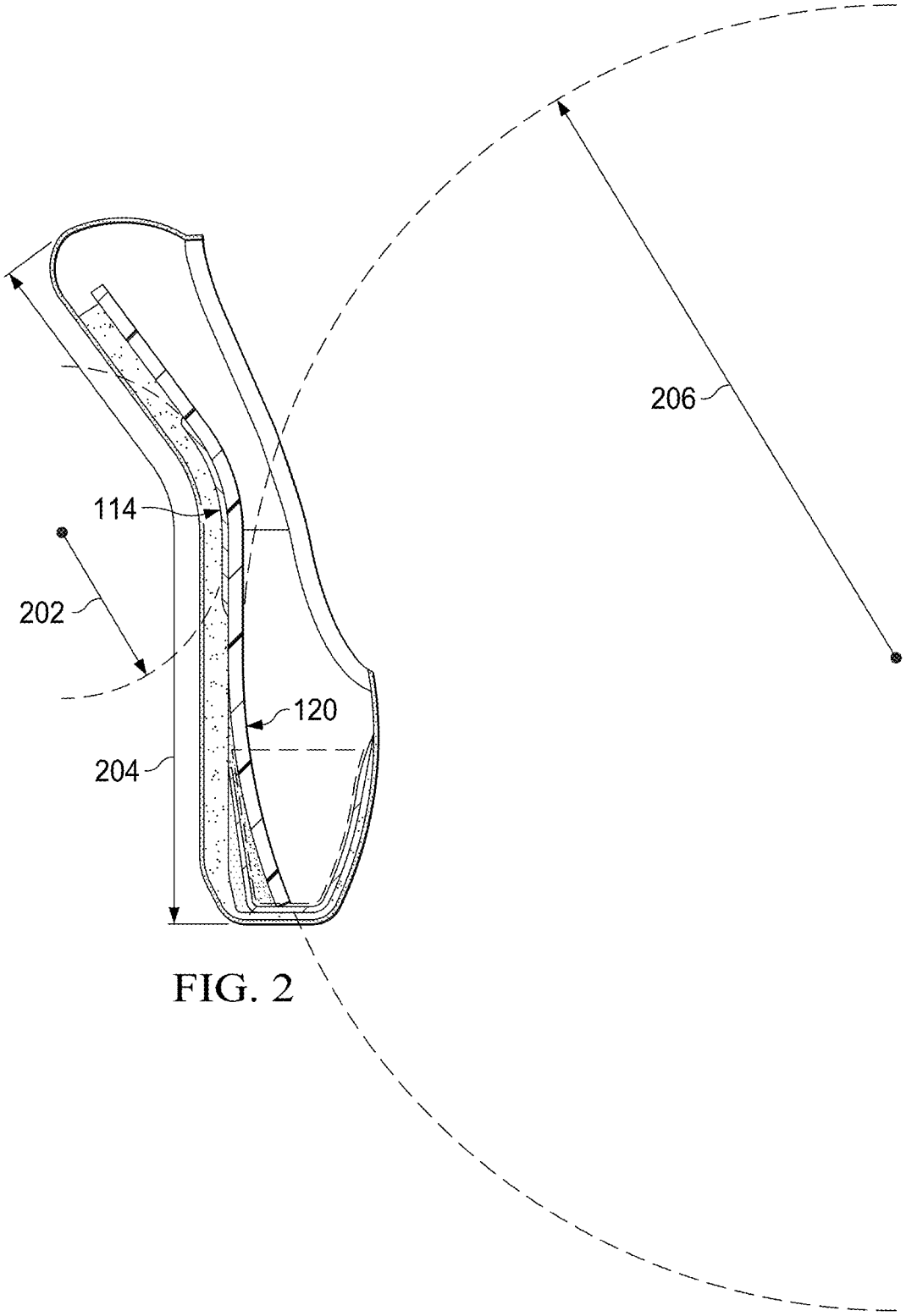
FIG. 2 illustrates a ballet pointe shoe according to an embodiment of the disclosure.

In regard to the size of the first curve 114, FIG. 2 illustrates an embodiment of the ballet pointe shoe 100 with the first curve 114 having a radius of curvature 202. The radius of curvature 202 is measured at the peak of the first curve 114. The ballet pointe shoe 100 also comprises a length 204 from a front end closest to the toebox 102 to a back end closest to the heel 106. A ratio of (i) the radius of curvature 202 of the first curve 114 to (ii) the length 204 of the ballet pointe shoe 100 from a front end closest to the toebox 102 to a back end closest to the heel 106 may be less than 100%. In other embodiments, the ratio of (i) the radius of curvature 202 of the first curve 114 to (ii) the length 204 of the ballet pointe shoe 100 from the front end closest to the toebox 102 to the back end closest to the heel 106 may be between 5% and 75%, between 10% and 55%, between 15% and 35%, or between some other range of percentages less than 100%.

Returning to FIG. 1, in an embodiment, the ballet pointe shoe 100 also comprises a flexible support member 116. The flexible support member 116 may elastically set the shank 110 in the first curve 114 at the time of manufacturing of the ballet pointe shoe 100. The flexible support member 116 may be a separate component coupled to the shank 110 as shown in FIG. 1 or the flexible support member 116 may be a part of the shank 110. The flexible support member 116 may enable the ballet pointe shoe 100 to flatten when weight is applied and then elastically return to the first curve 114. The flexible support member 116 may be made of a material comprising one or more of rubber, sulfur, plastic, fiberboard, resin, carbon fiber, bamboo, spring steel, or any combination thereof. In an embodiment, the flexible support member 116 comprises vulcanite. In some embodiments, the first curve 114 may be set in part by applying a weighted press to the shank 110 and the flexible support member 116 while fitted to the particular last. The ballet pointe shoe 100 may also comprise at last one tack 118 through the sole 108, the flexible support member 116, and into the shank 110.

The ballet pointe shoe 100 with the larger first curve 114 and the flexible support member 116 has numerous advantageous over traditional ballet pointe shoes. For example, aesthetically the ballet pointe shoe 100 looks nicer en pointe than traditional ballet pointe shoes. Additionally, the ballet pointe shoe 100 is already broken via its initial construction to fit the dancer's foot en pointe. This saves dancers the many hours it takes to break in traditional ballet pointe shoes. Furthermore, since the ballet pointe shoe 100 does not need to be broken in and the ballet pointe shoe 100 includes the flexible support member 116 positioned at the preferred break point, it is believed that the ballet pointe shoe 100 should have a greater lifespan than a traditional ballet pointe shoe.

In an embodiment, the ballet pointe shoe 100 also comprises a second curve 120 of the shank 110. The second curve 120 is at least partially within the toebox 102. The second curve 120 of the shank 110 is established during manufacturing prior to first use. The second curve 120 positions at least the toes of the dancer at an angle that increases from a back of the toebox 102 to a front of the toebox 102 when the dancer is wearing the ballet pointe shoe. The second curve 120 of the shank 110 may be established using a particular last that includes angled negative space within the toebox 102. The second curve 120 may be established during manufacturing by adding a wedge component to the shank 110 to fill the angled negative space created using the particular last. Alternatively, the second curve 120 may be built as part of the shank 110. Additional details regarding the wedge component and/or a wedge built as part the shank can be found in U.S. Pat. No. 9,491,981 issued Nov. 15, 2016 and entitled "Toe Wedge for a Ballet Pointe Shoe," the contents of which are hereby incorporated by reference in their entirety for all purposes.

In regard to size of the second curve 120, returning to FIG. 2, the ballet pointe shoe 100 includes the second curve 120 having a radius of curvature 206. The radius of curvature 206 is measured at the trough of the second curve 120. A ratio of (i) the radius of curvature 206 of the second curve 120 to (ii) the length 204 of the ballet pointe shoe 100 from the front end closest to the toebox 102 to the back end closest to the heel 106 may be at least 25%. In other embodiments, the ratio of (i) the radius of curvature 206 of the second curve 120 to (ii) the length 204 of the ballet pointe shoe 100 from the front end closest to the toebox 102 to the back end closest to the heel 106 may be at least 60%, at least 75%, at least 90%, or some other percentage greater than 25%.

The first curve 114 and the second curve 120 established during manufacturing create a dual curve system for the ballet pointe shoe 100. The dual curve system includes a positive curve (i.e., the first curve 114) and a negative curve (i.e., the second curve 120) on the inner part of the ballet pointe shoe 100 that is against the dancer's foot (e.g., the shank 110, etc.). The positive and negative curves help mimic the shape of the bottom of the foot. This dual curve system is different than traditional ballet pointe shoes, which include a single, smaller positive curve at the arch of the dancer's foot. The dual curve system of the ballet pointe shoe 100 creates an ergonomic shape against the bottom and back of the dancer's foot, maintaining more stable contact and positioning between the foot (including the arch and the toes) and the shoe throughout a dance.

In some embodiments, the ballet pointe shoe 100 may be considered a high-waisted ballet pointe shoe. The waist of the sole 108 is defined as the narrowest part of the sole 108. The waist of the sole 108 of the ballet pointe shoe 100 may be located closer to the heel 106 than in traditional ballet pointe shoes, thereby making the ballet pointe shoe 100 high-waisted. The positioning of the waist of the soke 108 closer to the heel 106 has several advantages including elevating and lifting the dancer, allowing her to "break" the shoe in the correct place to fit her arch, and thereby gaining more control of her foot movement. Additionally, the life of the ballet pointe shoe 100 is extended with the positioning of the waist of the sole 108 closer to the heel 106 since the dance is able to "break" the shoe in the correct place. Additional details regarding a high-waisted ballet pointe shoe can be found in U.S. Pat. No. 11,026,474 issued Jun. 8, 2021 and entitled "Ballet Pointe Shoe," the contents of which are hereby incorporated by reference in their entirety for all purposes.

Figure 3:
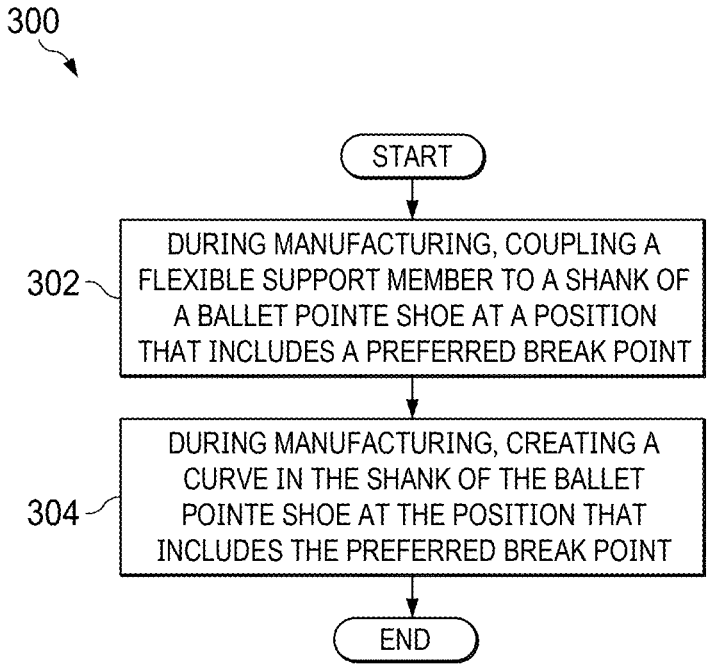
FIG. 3 illustrates a flow chart of manufacturing a ballet pointe shoe according to an embodiment of the disclosure.

Turning to FIG. 3, a method 300 of manufacturing a ballet pointe shoe 100 is described. At block 302, during manufacturing, a flexible support member (e.g., flexible support member 116) is coupled to a shank (e.g., shank 110) of a ballet pointe shoe (e.g., ballet point shoe 100) at a position that includes a preferred breaking point. At block 304, during manufacturing, a curve (e.g., the first curve 114) is created in the shank of the ballet pointe shoe at the position that includes the preferred breaking point. In an embodiment, the curve is created in the shank of the ballet pointe shoe while supported by the flexible support member in part by applying a weighted press to the shank and the flexible support member while fitted to a particular last that includes the curve. The flexible support member may be coupled to the shank before or after the curve is created. With respect to the size of the curve created, a ratio of (i) a radius of curvature of the curve to (ii) a length of the ballet pointe shoe from a front end closest to a toebox (e.g., toebox 102) to a back end closest to a heel (e.g., heel 106) may be less than 100%. In other embodiments, the ratio of (i) the radius of curvature of the curve to (ii) the length of the ballet pointe shoe from the front end closest to the toebox to the back end closest to the heel may be between 5% and 75%, between 10% and 55%, between 15% and 35%, or between some other range of percentages less than 100%. The flexible support member elastically sets the shank in the curve at the time of manufacturing of the ballet pointe shoe. During use of the ballet pointe shoe, the flexible support member enables the ballet pointe shoe to flatten when weight is applied and then elastically return to the curve.

As illustrated, FIG. 3 includes a number of enumerated operations, but embodiments of the operations in FIG. 3 may include additional operations before, after, and in between the enumerated operations. In some embodiments, one or more of the enumerated operations may be omitted or performed in a different order.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

EXAMPLES

The disclosure having been generally described, the following examples are given as particular embodiments of the disclosure and to demonstrate the practice and advantages thereof. It is understood that the examples are given by way of illustration and are not intended to limit the specification or the claims in any manner.

The measurements below were performed on ballet pointe shoes in the U.K. Size 5-6 range. While pictures of the ballet pointe shoes were used for the picture measurements and to determine the actual radius of curvature of the ballet pointe shoe by applying the following formula, the actual radius of curvature could have been determined from the ballet pointe shoe itself.

$$\frac{\text{Picture Radius of Curvature}}{\text{Picture lenghth from front of toebox to back of heel}} = \frac{X}{\text{Actual length from front of toebox to back of heel}}$$

Example 1

Ballet Pointe Shoe 100

TABLE 1

| Picture Radius of Curvature of the First Curve (in mm) | Picture Length of Shoe from Front of Toebox to Back of Heel (in mm) | Actual Length of Shoe from Front of Toebox to Back of Heel (in inches) | Actual Length of Shoe from Front of Toebox to Back of Heel (in mm) | Picture Radius of Curvature of the Second Curve (in mm) |
|---|---|---|---|---|
| 31.53 | 126 | 8.5 | 215.9 | 125.2 |

Table 1 provides measurements of the ballet pointe shoe 100.

TABLE 2

| Actual Radius of Curvature of the First Curve (in mm) | Actual Radius of Curvature of the First Curve (in inches) | Actual Radius of Curvature of the Second Curve (in mm) | Actual Radius of Curvature of the Second Curve (in inches) |
|---|---|---|---|
| 54.02640476 | 2.12702381 | 214.5292063 | 8.446031746 |

Table 2 provides the calculated actual radius of curvatures of the first and second curves of the ballet pointe shoe 100 (in millimeters and inches) using the formula provided above and the measurements in Table 1.

TABLE 3

| Ratio of Actual Radius of Curvature of the First Curve to Actual Length of Shoe | % of Actual Radius of Curvature of the First Curve to Actual Length of Shoe | Ratio of Actual Radius of Curvature of the Second Curve to Actual Length of Shoe | % of Actual Radius of Curvature of the Second Curve to Actual Length of Shoe |
|---|---|---|---|
| 0.250238095 | 25.02380952 | 0.993650794 | 99.36507937 |

Table 3 provides the calculated ratio and percentage of (i) the radius of curvature of each curve to (ii) the length of the ballet pointe shoe from the front end closest to the toebox to the back end closest to the heel for ballet pointe shoe 100 using the data in Tables 1 and 2.

Example 2

Ballet Pointe Shoes Manufactured by Others

TABLE 4

| Ballet Pointe Shoes Manufactured by Others | Picture Radius of Curvature of the First Curve (in mm) | Picture Length of Shoe from Front of Toebox to Back of Heel (in mm) | Actual Length of Shoe from Front of Toebox to Back of Heel (in inches) | Actual Length of Shoe from Front of Toebox to Back of Heel (in mm) | Picture Radius of Curvature of the Second Curve (in mm) |
|---|---|---|---|---|---|
| Shoe 1 | 133.2 | 120 | 8.25 | 209.55 | 0 |
| Shoe 2 | 148.16 | 121 | 8.25 | 209.55 | 0 |
| Shoe 3 | 195.27 | 119 | 8.125 | 206.375 | 0 |
| Shoe 4 | 210.96 | 131 | 8 | 203.2 | 0 |
| Shoe 5 | 230.58 | 122 | 8.5 | 215.9 | 0 |
| Shoe 6 | 254.56 | 121 | 8.25 | 209.55 | 0 |
| Shoe 7 | 284.42 | 124 | 8.5 | 215.9 | 0 |
| Shoe 8 | 298.82 | 129 | 8.5 | 215.9 | 0 |
| Shoe 9 | 298.93 | 121 | 8.25 | 209.55 | 0 |
| Shoe 10 | 360.08 | 125 | 8.25 | 209.55 | 0 |

Table 4 provides measurements of ballet pointe shoes manufactured by others.

TABLE 5

| Ballet Pointe Shoes Manufactured by Others | Actual Radius of Curvature of the First Curve (in mm) | Actual Radius of Curvature of the First Curve (in inches) | Actual Radius of Curvature of the Second Curve (in mm) | Actual Radius of Curvature of the Second Curve (in inches) |
|---|---|---|---|---|
| Shoe 1 | 232.6005 | 9.1575 | 0 | 0 |
| Shoe 2 | 256.5861818 | 10.10181818 | 0 | 0 |
| Shoe 3 | 338.6457668 | 13.3325105 | 0 | 0 |
| Shoe 4 | 327.2295573 | 12.88305344 | 0 | 0 |
| Shoe 5 | 408.051 | 16.065 | 0 | 0 |
| Shoe 6 | 440.8516364 | 17.35636364 | 0 | 0 |
| Shoe 7 | 495.2119194 | 19.49653226 | 0 | 0 |
| Shoe 8 | 500.118124 | 19.68968992 | 0 | 0 |
| Shoe 9 | 517.6924091 | 20.38159091 | 0 | 0 |
| Shoe 10 | 603.638112 | 23.76528 | 0 | 0 |

Table 5 provides the calculated actual radius of curvatures of the first and second curves of the ballet pointe shoes manufactured by others (in millimeters and inches) using the formula provided above and the measurements in Table 4.

TABLE 6

| Other Ballet Pointe Shoes Manufactured by Others | Ratio of Actual Radius of Curvature of the First Curve to Actual Length of Shoe | % of Actual Radius of Curvature of the First Curve to Actual Length of Shoe | Ratio of Actual Radius of Curvature of the Second Curve to Actual Length of Shoe | % of Actual Radius of Curvature of the Second Curve to Actual Length of Shoe |
|---|---|---|---|---|
| Shoe 1 | 1.11 | 111 | 0 | 0 |
| Shoe 2 | 1.22446281 | 122.446281 | 0 | 0 |
| Shoe 3 | 1.64092437 | 164.092437 | 0 | 0 |
| Shoe 4 | 1.610381679 | 161.0381679 | 0 | 0 |
| Shoe 5 | 1.89 | 189 | 0 | 0 |
| Shoe 6 | 2.103801653 | 210.3801653 | 0 | 0 |
| Shoe 7 | 2.293709677 | 229.3709677 | 0 | 0 |
| Shoe 8 | 2.316434109 | 231.6434109 | 0 | 0 |
| Shoe 9 | 2.470495868 | 247.0495868 | 0 | 0 |
| Shoe 10 | 2.88064 | 288.064 | 0 | 0 |

Table 6 provides the calculated ratio and percentage of (i) the radius of curvature of each curve to (ii) the length of the ballet pointe shoe from the front end closest to the toebox to the back end closest to the heel for each of the ballet pointe shoes manufactured by others using the data in Tables 4 and 5.

What is claimed is:

1. A ballet pointe shoe prior to first use by a dancer, comprising:

a toebox;

a platform at a front end of the toebox;

a shank;

an upper;

a heel;

a first curve on the shank between the heel and the toebox positioned to include a preferred break point, wherein the first curve follows an arch of the dancer's foot when the dancer is wearing the ballet pointe shoe, and wherein a first ratio of (i) a radius of curvature of the first curve to (ii) a length of the ballet pointe shoe from a front end closest to the toebox to a back end closest to the heel is between 15% and 35%; and a second curve on the shank at least partially within the toebox, wherein the second curve positions at least the toes of the dancer at an angle that increases from a back of the toebox to a front of the toebox when the dancer is wearing the ballet pointe shoe, wherein a second ratio of (i) a radius of curvature of the second curve to (ii) the length of the ballet pointe shoe from the front end closest to the toebox to the back end closest to the heel is at least 25%.

2. The ballet pointe shoe of claim 1, wherein the ratio of (i) the radius of curvature of the second curve to (ii) the length of the ballet pointe shoe from the front end closest to the toebox to the back end closest to the heel is at least 60%.

3. The ballet pointe shoe of claim 2, wherein the ratio of (i) the radius of curvature of the second curve to (ii) the length of the ballet pointe shoe from the front end closest to the toebox to the back end closest to the heel is at least 90%.

4. The ballet pointe shoe of claim 1, wherein the preferred break point comprises the arch of the dancer's foot when the dancer is wearing the ballet pointe shoe.

5. The ballet pointe shoe of claim 1, wherein the first curve, the first ratio, the second curve, and the second ratio are established during manufacturing of the ballet pointe shoe.

6. A ballet pointe shoe prior to first use by a dancer, comprising:

a toebox;
a platform;
a heel;
an upper;
a shank;
a sole;
a first curve on the shank between the heel and the toebox positioned to include a preferred break point, wherein the first curve follows an arch of the dancer's foot when the dancer is wearing the ballet pointe shoe, and wherein a first ratio of (i) a radius of curvature of the first curve to (ii) a length of the ballet pointe shoe from a front end closest to the toebox to a back end closest to the heel is between 15% and 35%;
a second curve on the shank at least partially within the toebox, wherein the second curve positions at least the toes of the dancer at an angle that increases from a back of the toebox to a front of the toebox when the dancer is wearing the ballet pointe shoe; and
a flexible support member positioned at the first curve that elastically sets the shank in the first curve at the time of manufacturing of the ballet pointe shoe, wherein the flexible support member enables the ballet pointe shoe to flatten when weight is applied and elastically return to the first curve.

7. The ballet pointe shoe of claim 6, wherein the flexible support member is coupled to the shank.

8. The ballet pointe shoe of claim 6, wherein the flexible support member is part of the shank.

9. The ballet pointe shoe of claim 6, wherein the flexible support member is made of a material comprising one or more of rubber, sulfur, plastic, fiberboard, resin, carbon fiber, bamboo, spring steel, or any combination thereof.

10. The ballet pointe shoe of claim 9, wherein the flexible support member comprises vulcanite.

11. The ballet pointe shoe of claim 6, further comprising at least one tack through the sole, the flexible support member, and into the shank.

12. A ballet pointe shoe prior to first use by a dancer, comprising:

a toebox;
a platform;
a heel;
an upper;
a shank;
a sole;
a first curve on the shank between the heel and the toebox positioned to include a preferred break point, wherein the first curve follows an arch of the dancer's foot when the dancer is wearing the ballet pointe shoe, wherein a first ratio of (i) a radius of curvature of the first curve to (ii) a length of the ballet pointe shoe from a front end closest to the toebox to a back end closest to the heel is less than or equal to 35%;
a second curve on the shank at least partially within the toebox, wherein the second curve positions at least the toes of the dancer at an angle that increases from a back of the toebox to a front of the toebox when the dancer is wearing the ballet pointe shoe; and
a discrete flexible support member positioned at the first curve that elastically sets the shank in the first curve at the time of manufacturing of the ballet pointe shoe, wherein the flexible support member enables the ballet pointe shoe to flatten when weight is applied and then elastically return to the first curve.

13. The ballet pointe shoe of claim 12, wherein the discrete flexible support member is coupled to the shank.

14. The ballet pointe shoe of claim 12, wherein the discrete flexible support member is made of a material comprising one or more of rubber, sulfur, plastic, fiberboard, resin, carbon fiber, bamboo, spring steel, or any combination thereof.

15. The ballet pointe shoe of claim 14, wherein the discrete flexible support member comprises vulcanite.

16. The ballet pointe shoe of claim 12, wherein a second ratio of (i) a radius of curvature of the second curve to (ii) the length of the pointe shoe from the front end closest to the toebox to the back end closest to the heel is at least 25%.

17. The ballet pointe shoe of claim 12, wherein the first curve, the first ratio, the second curve, and the second ratio are established during manufacturing of the ballet pointe shoe.

* * * * *